US005627577A

United States Patent [19]

Buican

[11] Patent Number: 5,627,577

[45] Date of Patent: May 6, 1997

[54] INK JET CARRIER WITH FLEXIBLE ELECTRICAL CABLE FOR CONNECTION TO A PRINTING APPARATUS

[75] Inventor: Eugene Buican, Cordova, Tenn.

[73] Assignee: Brother International Corporation, Somerset, N.J.

[21] Appl. No.: 368,306

[22] Filed: Jan. 4, 1995

[51] Int. Cl.[6] ..... B41J 2/01

[52] U.S. Cl. ..... 347/50

[58] Field of Search ..... 347/9, 49, 50

[56] References Cited

U.S. PATENT DOCUMENTS 4,706,097 11/1987 Harmon ..... 439/492
4,729,557 3/1988 Kiyohara ..... 271/272
4,907,018 3/1990 Pinkerpell et al. ..... 347/50
5,202,270 4/1993 Terasawa et al. ..... 347/32

*Primary Examiner*—Benjamin R. Fuller
*Assistant Examiner*—L. Anderson
*Attorney, Agent, or Firm*—Oliff & Berridge

[57] ABSTRACT

An ink cartridge carrier for an ink ejection printing apparatus that provides for positively attaching a flexible cable between the control unit and the ink cartridge carrier. The ink cartridge carrier has an integral construction with slots provided on either side of the front frame section for feeding an end of the flexible cable therethrough and engaging the end of the flexible cable. When the flexible cable is so engaged, contacts found on the flexible cable are properly positioned to contact contacts on a mounted ink cartridge.

21 Claims, 19 Drawing Sheets

INK JET CARRIER WITH FLEXIBLE ELECTRICAL CABLE FOR CONNECTION TO A PRINTING APPARATUS

BACKGROUND OF THE INVENTION

The invention relates to an ink jet printing apparatus having a flexible electrical connector between the printer control and the printhead.

Printers of this type require an electrical connection from the printer control to the printhead to ensure activation of the appropriate nozzles for ejection of ink droplets in accordance with a dot pattern in order to create images on a print paper. In such devices, there is an ink cartridge carrier mounting an ink cartridge having a plurality of ink ejection channels and an ink chamber. The ink cartridge has a plurality of electrical contacts, each electrical contact being electrically connected to an ink ejection channel. The ink ejector may be either a resistance element generating heat to create a bubble for ejection of the droplet or a piezoelectric device for changing the volume of the ink ejection channel.

The flexible cable carries the signals from the control unit to the appropriate electrical contacts of the ink ejection channels on the ink cartridge. Thus, it is necessary to mount a contact end of the flexible cable to the ink cartridge carriage. To do so, prior art ink cartridge carriers were formed in at least two pieces, a main carriage body which receives the ink cartridge and a clamping member. The end of the flexible cable, having electrical contacts matched with the electrical contacts of the ink cartridge, is placed between the carriage and the clamping member. The clamping member is then closed to clamp and hold the end of the flexible cable.

Such an arrangement increases the complexity of the ink cartridge carrier thereby increasing its cost to manufacture and its assembly costs. It also provides another element of the printer subject to breakage.

SUMMARY OF THE INVENTION

The invention addresses the problem of the complexity of the prior art ink cartridge carriers. It does so by providing a one piece ink cartridge carrier in which the flexible cable retaining member is integral to the ink cartridge carrier. Thus, an object of the invention is to provide an ink cartridge carrier that is cheaper to produce.

Another object of the invention is to provide an ink carriage cartridge that is less complex, facilitates attachment of the flexible cable to the ink cartridge carrier and ensures accurate positioning of the electrical contacts.

The objects of the invention are achieved by an ink cartridge carriage, comprising an ink cartridge carriage of one piece construction having at least a first section, a second section, a cable mounting section extending between said first and second sections and a base section to form a substantially box shape structure with two open sides; a wing extending from each of said first and second sections in a direction away from and parallel to said cable mounting section; a first slot between one wing and the cable mounting section at an intersection where the cable mounting section and the first section are joined and a second slot between the second wing and the cable mounting section at an intersection where the cable mounting section and the second section are joined; an electrical cable having an end mounting portion and an intermediate mounting portion, the end and intermediate mounting portions having attachment means; and mounting means on each wing for receiving the attachment means.

BRIEF DESCRIPTION OF THE DRAWINGS

The invention will be better understood from the detailed description given herein below and the accompanying drawings which are given by way of illustration only, and thus are not limiting of the invention.

DESCRIPTION OF THE PREFERRED EMBODIMENT

Figure 1:
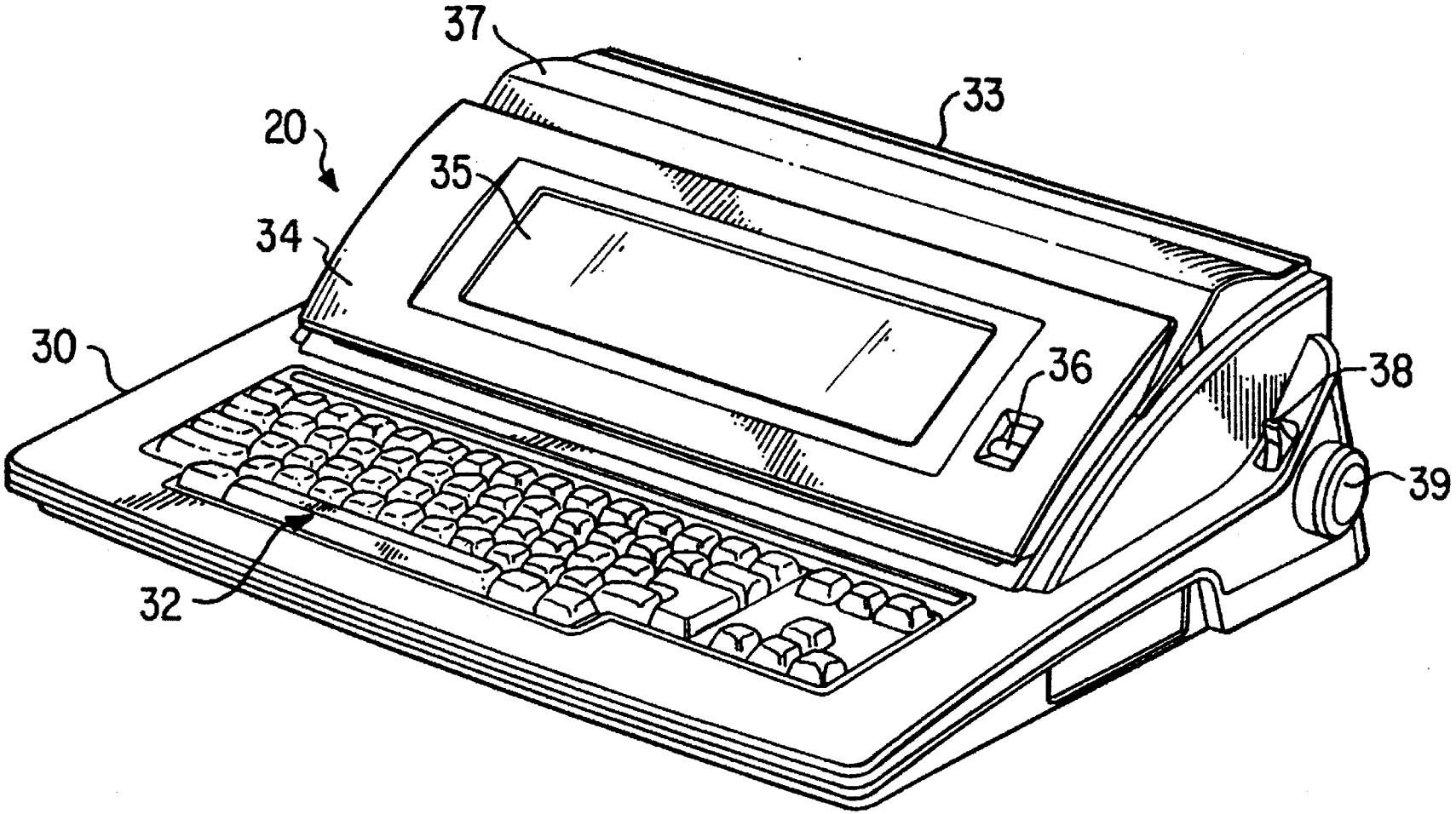
FIG. 1 is a perspective view of an electric typewriter embodying the invention.

The invention will hereinafter be described with reference to the drawings. FIG. 1 shows an electronic typewriter 20 embodying the invention. The electronic typewriter 20 is being used for illustrative purposes only as the invention may be embodied in other electronic printing apparatuses such as printers and facsimile machines employing ink jet printing elements. The print cartridges may be of either a thermal cartridge or a piezo electric cartridge type.

The electronic typewriter 20 of FIG. 1 has an outer frame 30. The input means comprises a keyboard 32 having alphanumeric, function, cursor, and control keys as are known in the art. Obviously, the input means would differ for a printer or a facsimile machine. A front panel 34 contains a display 35 and a contrast control 36 is provided for controlling contrast of the display 35. An upper panel 37 is provided to permit access to the interior of the outer frame 30. The front panel 34 may be rotated toward the keyboard and the upper panel 37 rotated away from the keyboard to provide access to the interior of the outer frame 30. A paper release 38 and a knob 39 for permitting rotation of main roller 91 (FIG. 6) are provided to one side of the outer frame 30. A back panel 33 lowers to provide a paper tray for feeding the sheet of paper prior to printing and for receiving the printed sheet of paper.

FIGS. 2–5 show the printing area of the invention. As previously noted, the invention is being described in the context of the electronic typewriter 20 of FIG. 1 but is applicable to any printing apparatus using ink jet print technology.

The printing means are mounted to a mounting frame 70 (FIG. 4) comprising a first side frame 71, a first lateral frame 72, a second side frame 73, and a second lateral frame 74. For purposes of this description, the first side frame 71 may be considered to be at the left when viewed in the figures and the first lateral frame 72 may be considered as closest to the observer when mounted in a printing mechanism. However, when actually mounted within a printing apparatus, the orientation may vary depending upon the structure of the printing apparatus.

Figure 2:
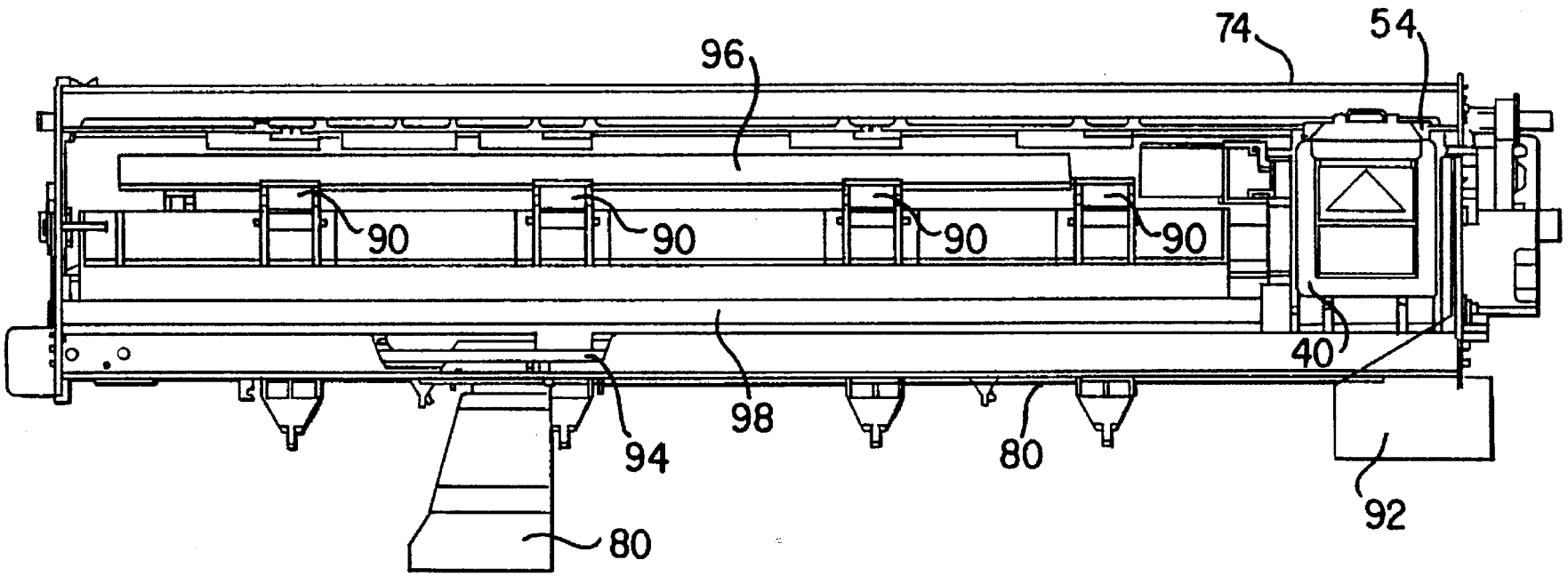
FIG. 2 is a top plan view of the print area with the ink cartridge carrier at a cleaning position.
Figure 4:
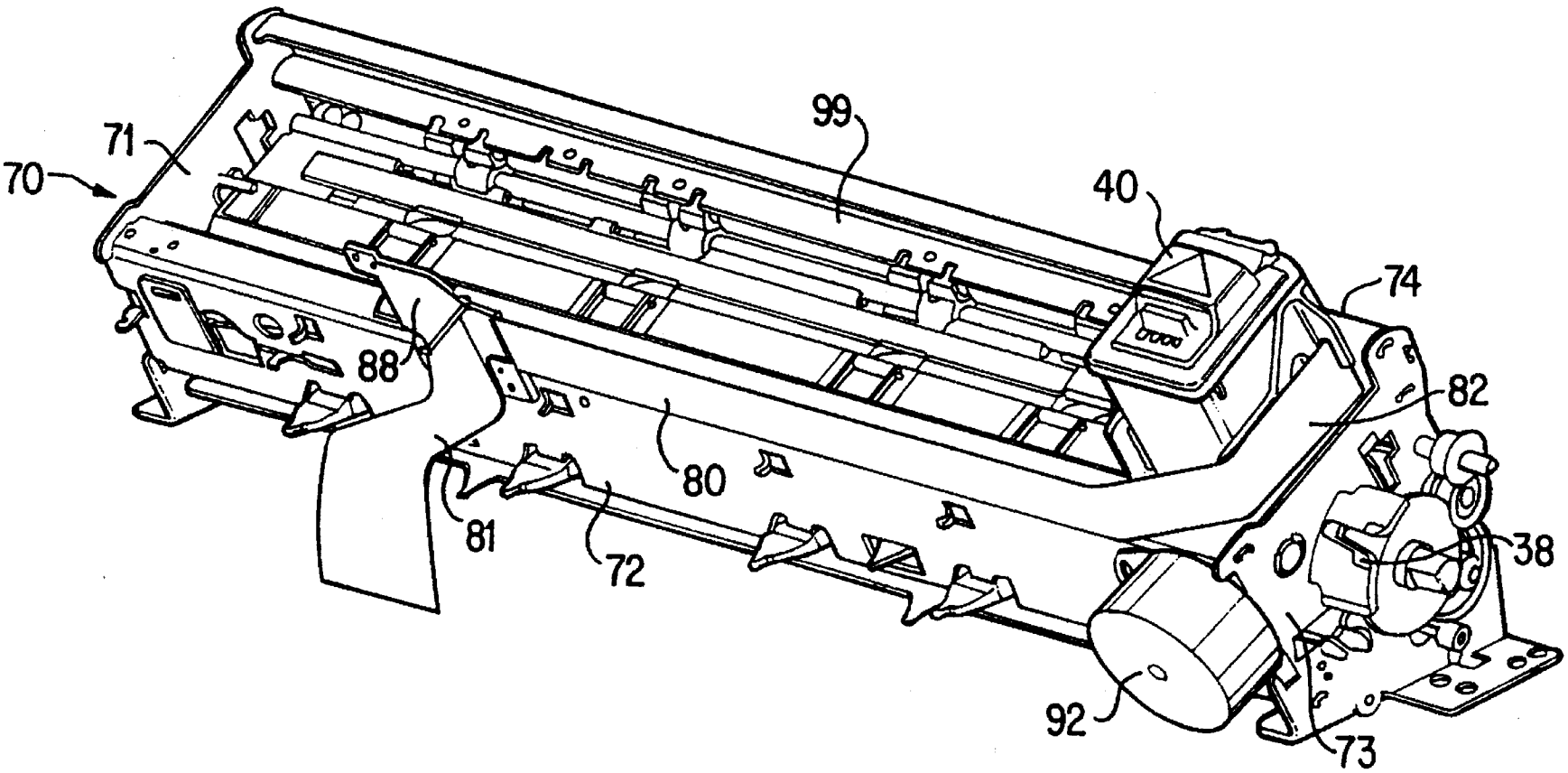
FIG. 4 is a top perspective view of the print area with the ink cartridge carrier at the cleaning position.

Extending between the first and second side frames 71,73 are a guide shaft 98 and a guide rail 99 (FIGS. 2 and 4). The guide shaft 98 and the guide rail 99 support the ink cartridge carrier 54 upon which the ink cartridge 40 is mounted. A motor 92 drives a timing belt 94 mounted to the ink cartridge carrier 54 to reciprocate the ink cartridge carrier 54 laterally along the guide shaft 98 and the guide rail 99.

A single sheet of paper is fed around feed path 102 (FIG. 6) and exits the direction shown by arrow A. At the entrance of the feed path 102 is the paper tray 33. A cut sheet feeder (not shown) feeds paper to paper feed opening 102*a* and thence to paper feed path 102. The paper feed opening 102*a* is also used to feed thicker paper products, such as postcards. Thus, the feed of paper may be a single sheet at a time or from a cut sheet feeder using known feed technologies. Further, the invention can be used with fan fold paper fed by a tractor feed.

The paper is fed through the feed path 102 by rotation of the main roller 91 (FIG. 6) and pinch rollers 90 (FIG. 2), across the block 96 and exited between feed rollers 104 and traction rollers 105. The feed rollers 104 are made of a resilient material and the traction rollers 105 are preferably of a metal having raised linear teeth. The raised linear teeth, triangular in cross-section, are smoothed at their apex such that the combination of the raised teeth of the traction rollers 105 and the resilient surface of the feed rollers 104 provide a positive gripping of the paper sheet.

Figure 3:
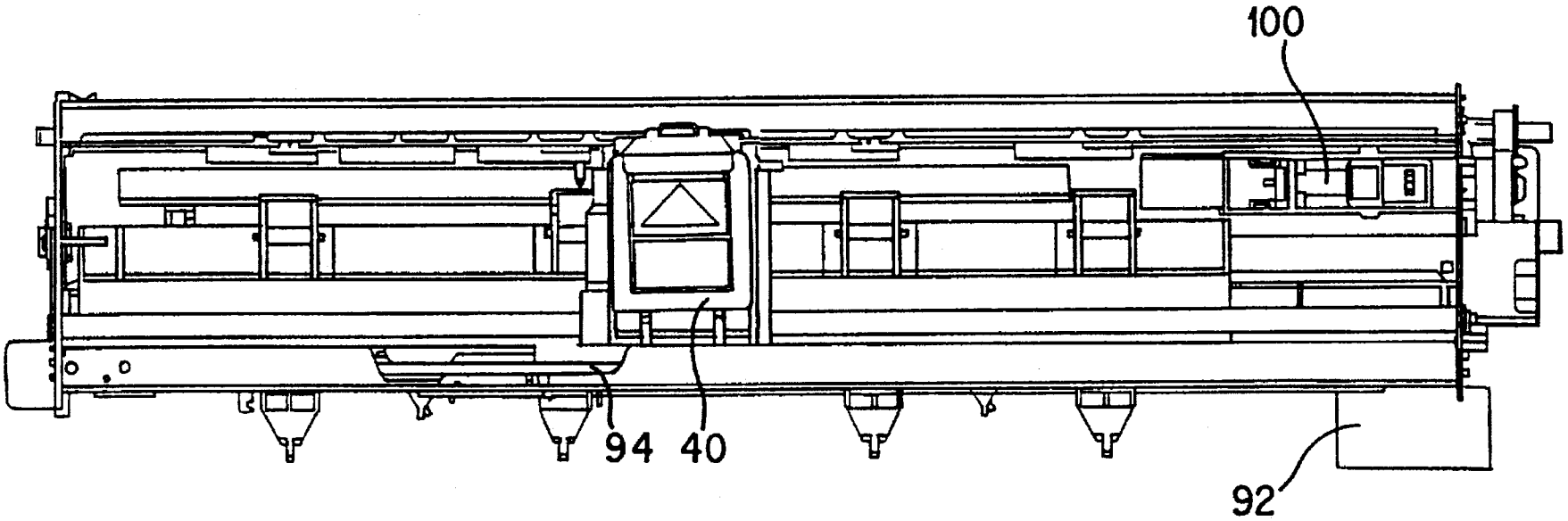
FIG. 3 is a top plan view of the print area with the ink cartridge carrier at a mid-print position, the figure is shown without the flexible cable.
Figure 5:
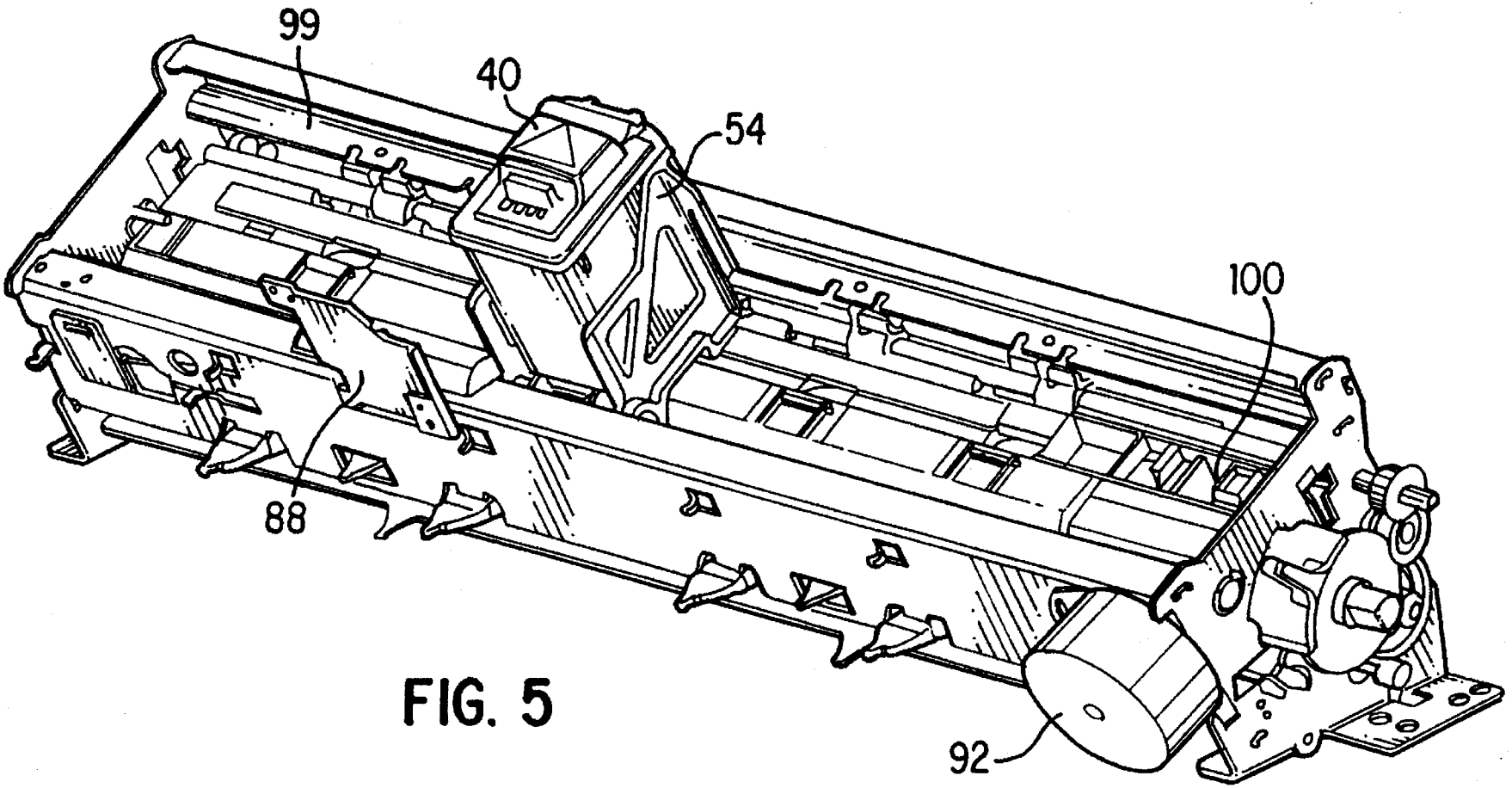
FIG. 5 is a top perspective view corresponding to FIG. 3.

Adjacent to the second side frame 73 is a head maintenance station 100 (FIGS. 3 and 5). The head maintenance station 100 may comprise a wiper member and a capping station to cover the printhead. A type maintenance station is shown in U.S. Pat. No. 5,202,702. FIGS. 2 and 4 show the ink cartridge carrier 54 at the head maintenance station 100.

During printing, the ink cartridge carrier 54 reciprocates along the guide shaft 98 and guide rail 99 between a position substantially adjacent to the first side frame 71 and a position adjacent to the head maintenance station 100. Head cleaning is executed on a predetermined basis that may be established based upon the number of lines printed, a set time interval, a combination of a number of characters and lines printed, or other appropriate measures depending upon the characteristics of the ink and the ink cartridge 40.

The ink cartridge carrier 54 will be described with reference to FIGS. 6–11. The ink cartridge carrier 54 is molded of a high strength resin material. An example of such a material is a polycarbonate with 10% fiber glass. The molded ink cartridge carrier 54 comprises a first side frame section 56, a second side frame section 57, a center frame section 55 connecting the first and second side frame sections 56,57, and a base frame section 58. The base frame section includes a guide shaft mount 60 and a positioning bar 58*a*.

The center frame section 55 has molded thereto guide members 59. Between guide members 59 is a notch 101. The ink cartridge carrier 54 is mounted to guide shaft 98 using guide shaft mount 60 and guide rail 99 is received in notch 101. To a rear portion of guide shaft mount 60 is formed a timing belt attachment bracket 61. The timing belt 94 is attached to the timing belt attachment bracket 61. The timing belt 94 may be either a split belt wherein each end of the timing belt 94 is attached to the timing belt attachment bracket 61 or it may be an endless belt with an attachment device, mounted on the timing belt 94, that is attached to the timing belt attachment bracket 61. In either case, the timing belt 94 is fixed with respect to the ink cartridge carrier 54 so that rotation of the motor 92 causes the timing belt 94 to be moved by rotation of an output shaft and pulley (not shown) thereby causing the ink cartridge carrier to reciprocate along the guide shaft 98 and guide rail 99.

Extending from each side frame section 56,57 is a wing 51. A plane passing through a surface of the wings 51 opposes a plane passing through an inner surface of the center frame section 55 and is parallel thereto. The gap between the two respective planes defines slots 65,66. A first slot 65 is defined at the junction of first side frame 56 and center frame section 55 and a second slot 66 is defined at the junction of second side frame section 57 and center frame section 55. Protruding from the surface of the wing 51 extending from first side frame section 56 is entry latching pin 67 and protruding from wing 51 extending from second side frame section 57 are end latching pins 68. Although as shown in this preferred embodiment of the ink cartridge carrier, the ink cartridge carrier 54 has one entry latching pin 67 and two end latching pins 68, other configurations of the latching pins could be used.

Figure 9A:
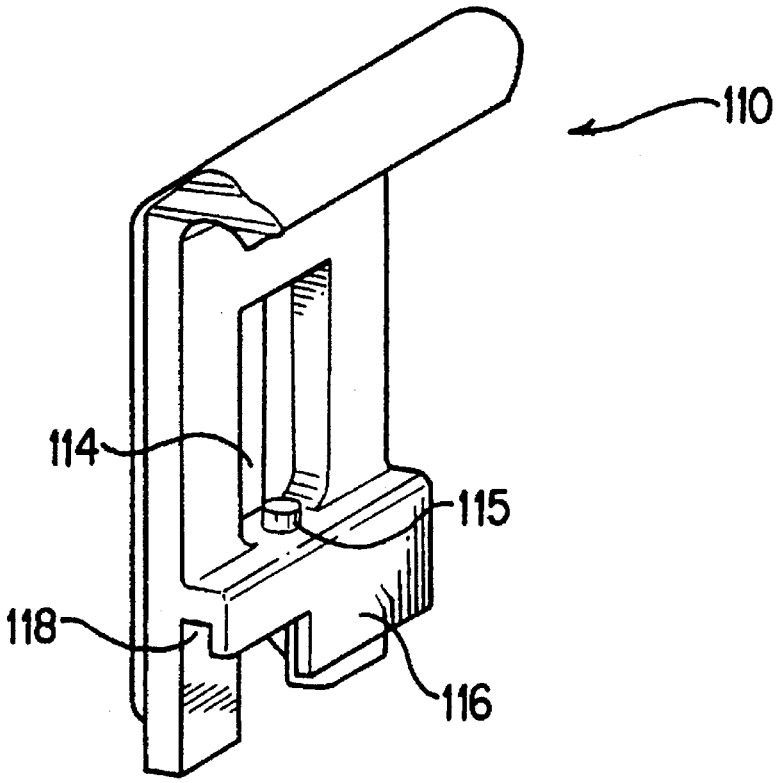
FIGS. 9A and 9B are front and rear perspective views of the latching bracket.
Figure 9B:
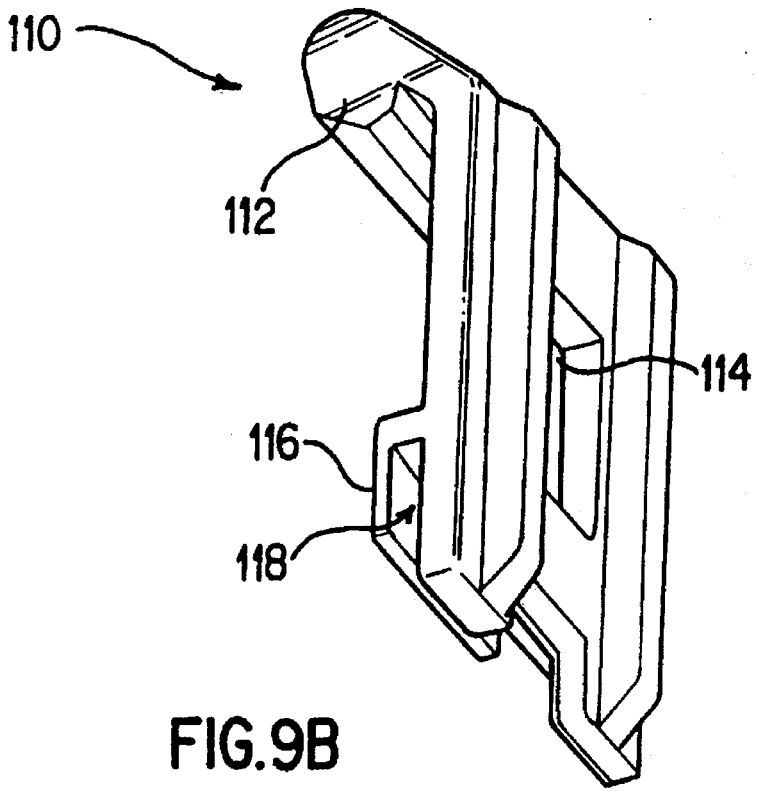
Figure 10:
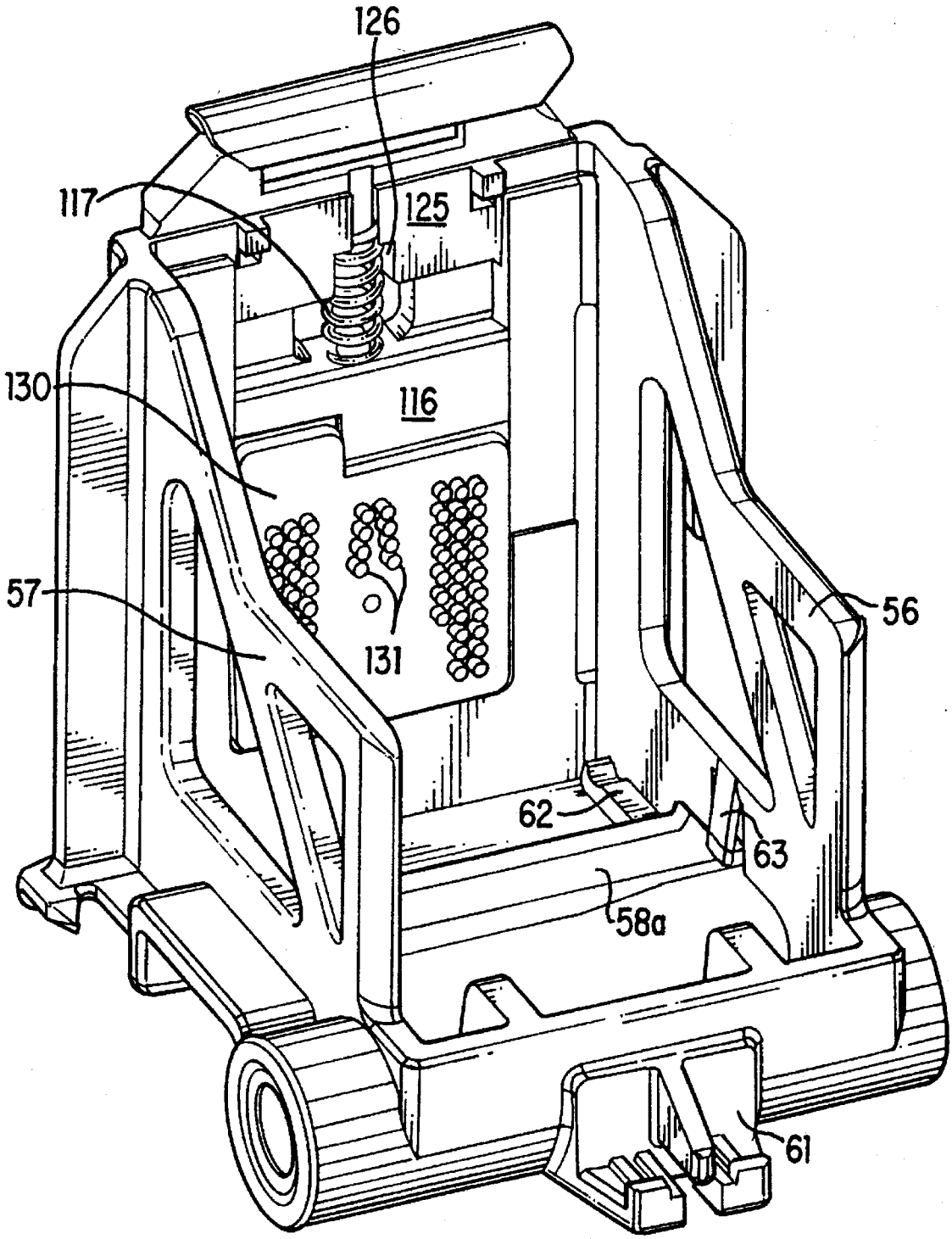
FIG. 10 is a left front, top perspective view of the ink cartridge carrier with the latching bracket attached.

To the ink cartridge carrier 54 is mounted a latching bracket 110 (FIG. 9A, 9B). The latching bracket 110 is formed of a high impact resin, such as those used for the ink cartridge carrier 54. The latching bracket 110 has an opening 114 and extending inwardly, that is toward the ink cartridge carrier 54, is a retention plate 116 having a downwardly descending L-shape, in cross section, to create a mounting notch 118 between the main bracket body and the descending leg of the retention plate 116. Protruding from an upper surface of the retention plate 116 is a spring guide 115.

Figure 16:
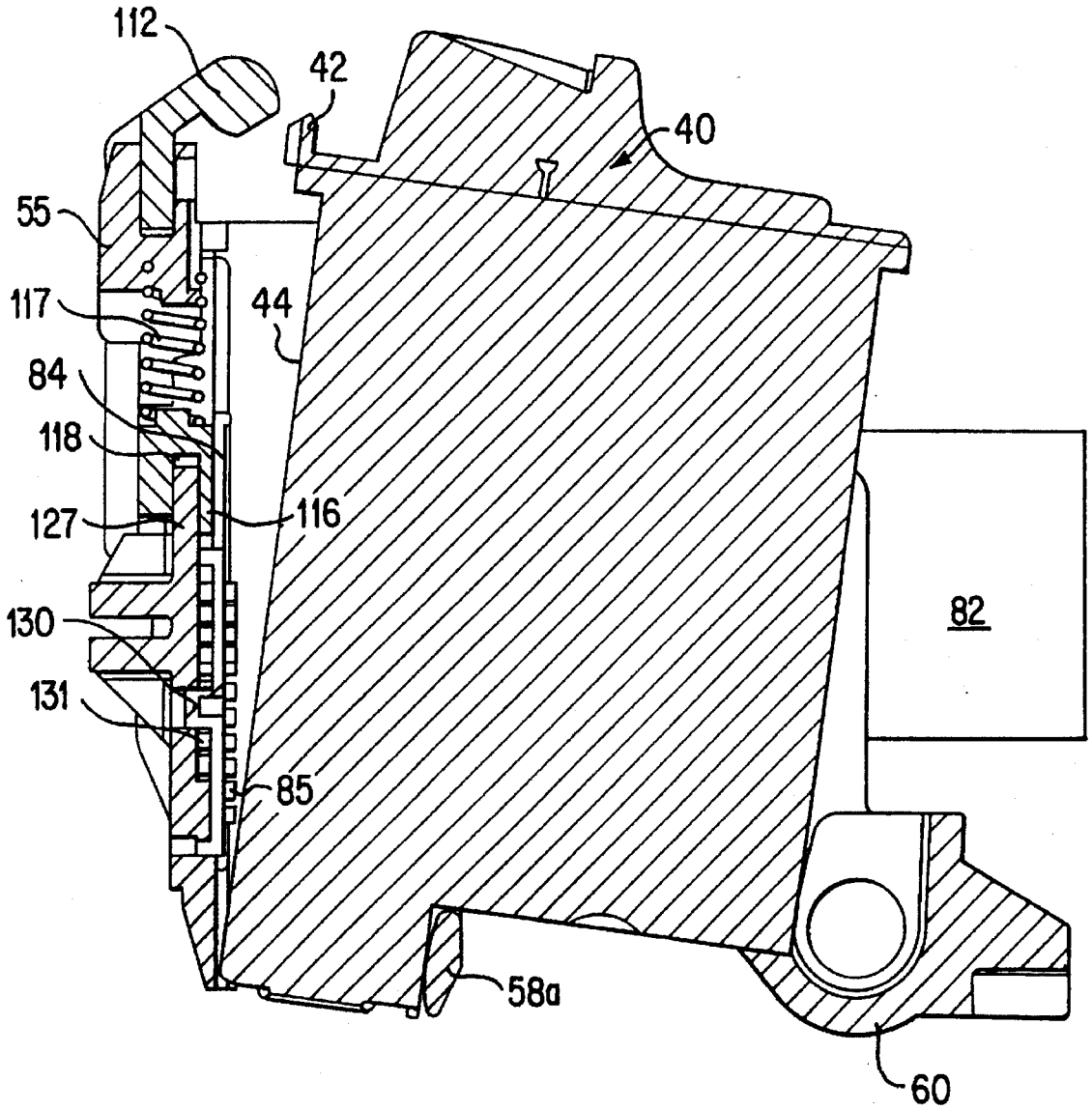
FIG. 16 is a side cut-away view of an ink cartridge being mounted on the ink cartridge carrier.
Figure 17:
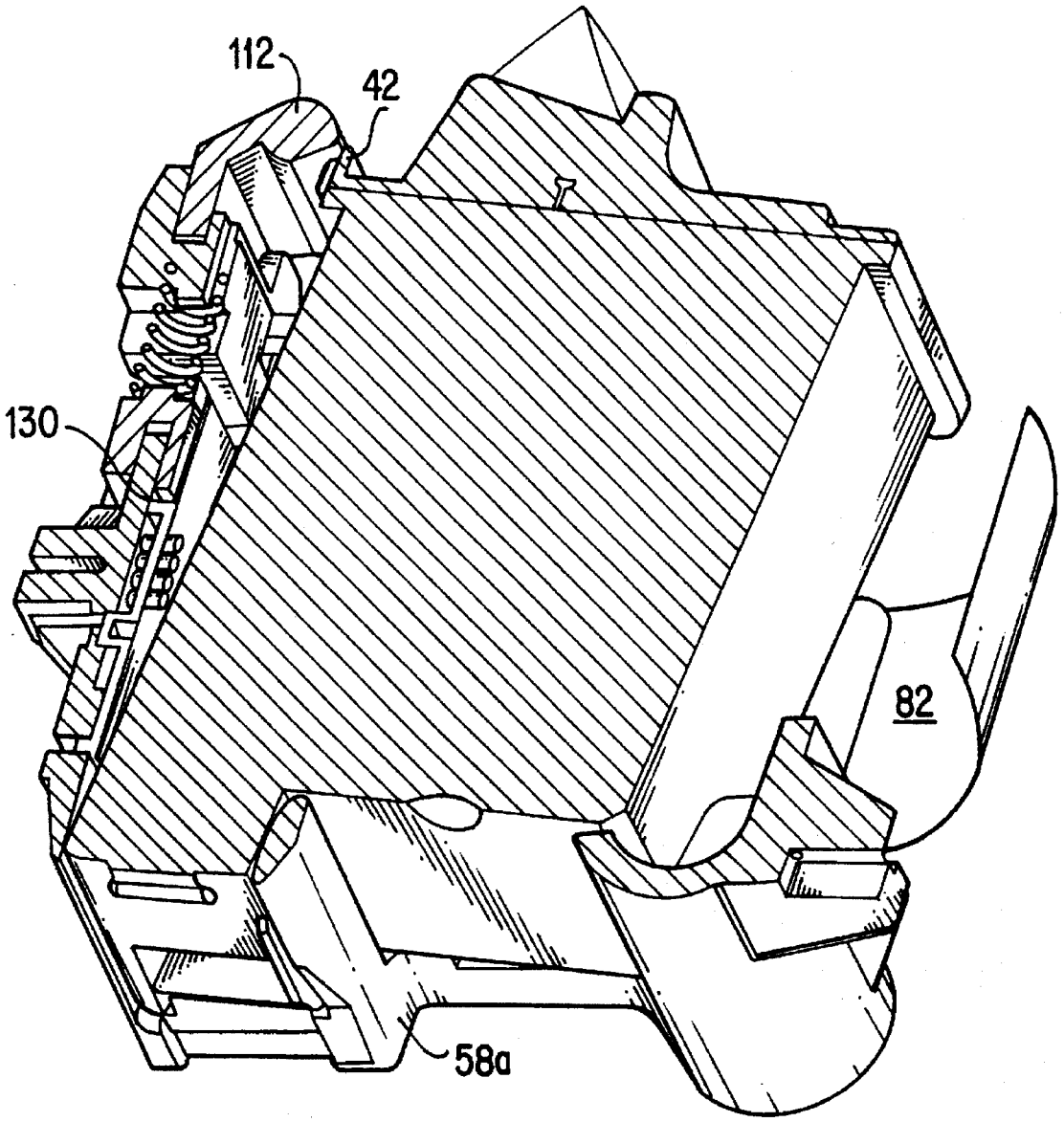
FIG. 17 is a bottom angle, cross-sectional perspective view of the ink cartridge being mounted on an ink cartridge carrier.
Figure 18:
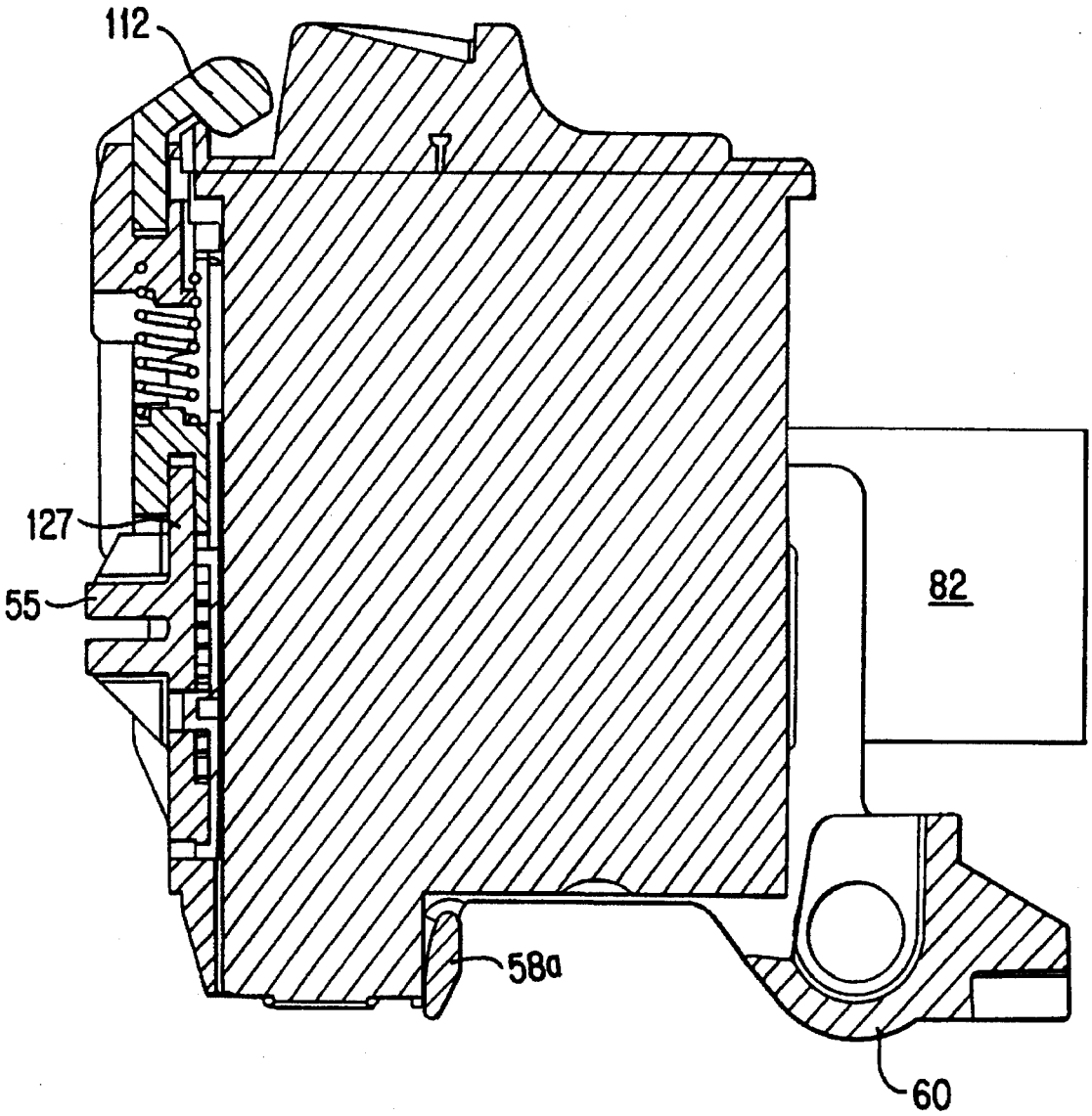
FIG. 18 is a side cut-away view of the ink cartridge mounted and latched on the ink cartridge carrier.
Figure 19:
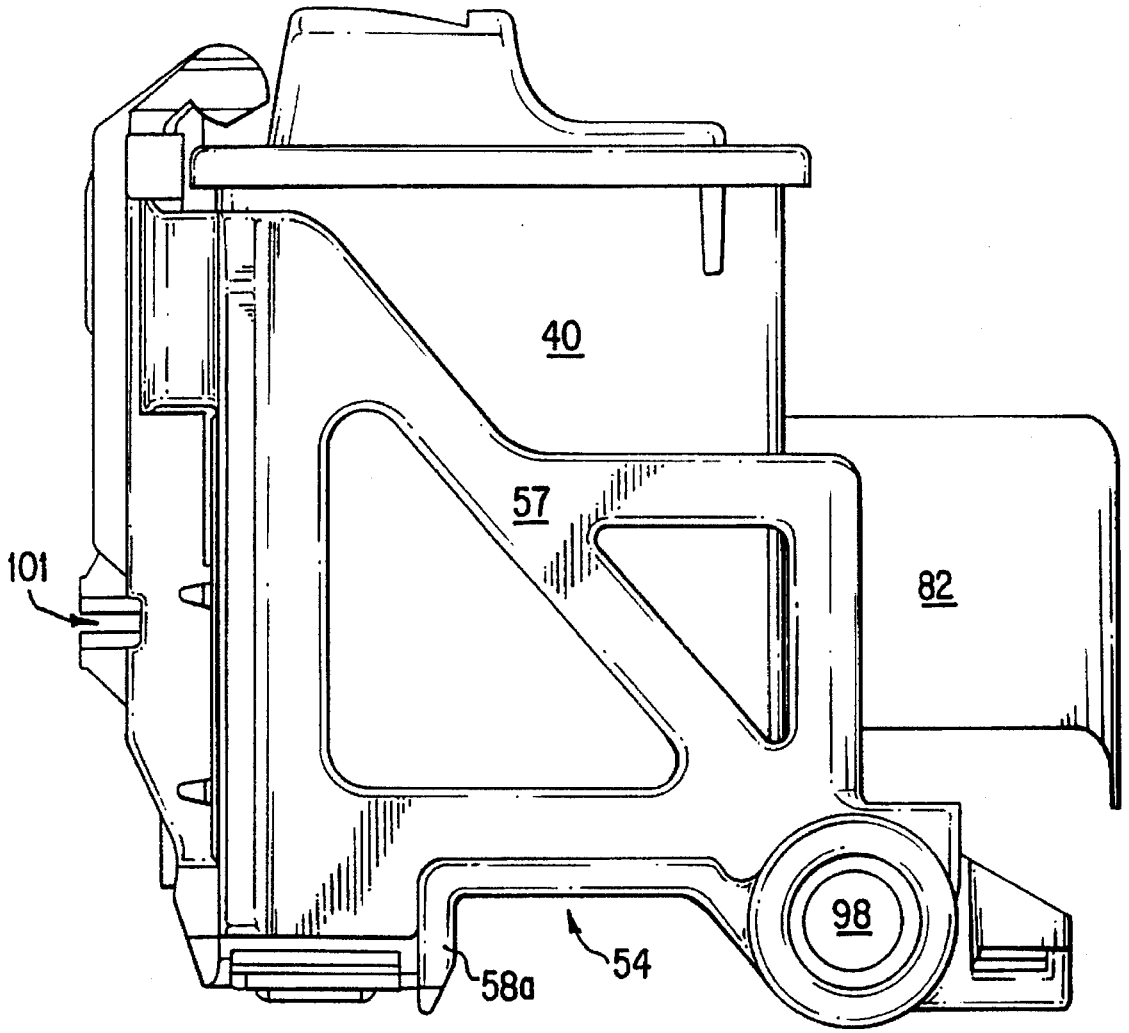
FIG. 19 is a side view of the ink cartridge carrier with an ink cartridge mounted thereon.

The latching bracket 110 is mounted in an opening 52 formed in the center frame section 55 (FIGS. 7 and 10–12). The retention plate 116, when the latching bracket 110 is mounted to the center frame section 55, is seated on an inner side of a center brace 127 of the center frame section 55 so that the center brace 127 is seated within mounting notch 118 of latching bracket 110 (FIG. 16). The portion of the latching bracket 110 defining an edge of the spring opening 114 adjacent a lip 112 (upper edge in the figures) is received in a groove formed in the top brace 125 of the center frame section 55.

Within the opening 52,114 (resulting when the latching bracket 110 is mounted to the center frame section 55) is a spring 117 that is seated on the spring guide 115 of the latching bracket 110 and engaged with a surface of the opening 52, the surface opposing the spring guide 115. To retain and guide the spring 117, the engagement surface found in top brace 125 of center frame section 55 is formed as a spring retention notch 126.

The latching bracket also has at its upper end (in the Figures) the lip 112. The spring 117, between the spring retention notch 126 in the top brace 125 of the center frame section 55 and the spring guide 115, applies a pressure to force the latching bracket 110 downwardly (in the Figures) so as to seat mounting notch 118 on center brace 127 of center frame section 55.

The mounting of the latching bracket 110 on the center frame section 55 is stabilized by the top brace 125 of the center frame section 55. The portion of the latching bracket 110 above the spring opening 114 is retained within a notch in the upper portion of the top brace 125 thus slidably attaching the latching bracket 110 at a second point to the center frame section 55. The spring 117, as previously described, engages an upper surface of the opening 52 of the center frame section 55 by being seated within the spring retention notch 126 found in the top brace 125 to complete the mounting.

Figure 15:
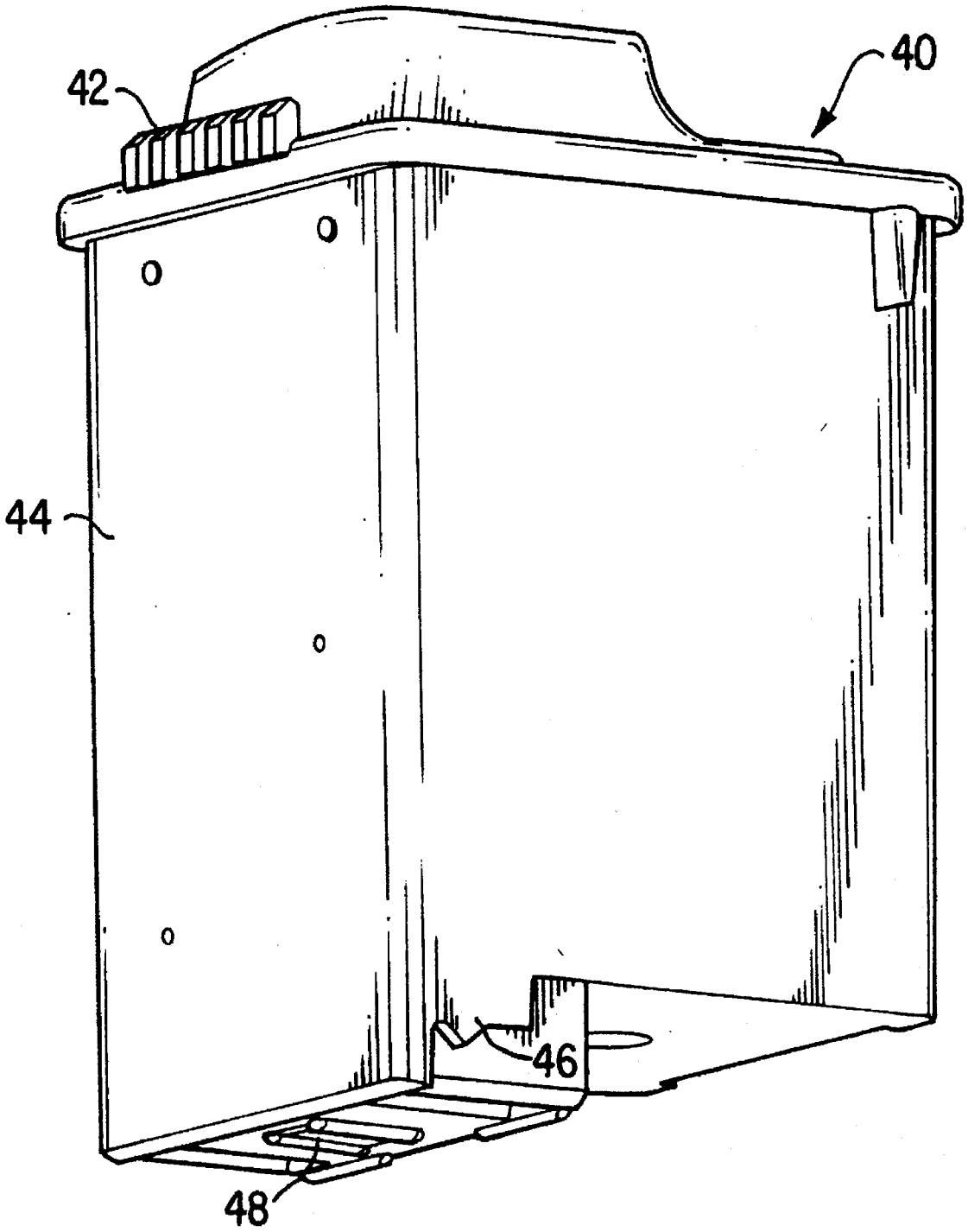
FIG. 15 is a perspective view of the ink cartridge.

Mounted to an inner surface, that is a surface of center frame section 55 facing into the area defined by first and second side frame sections 56,57, is a contact spring member 130 having contact springs 131 formed thereon. The contact spring member 130 and contact springs 131 are formed of a resilient substance, such as silicon rubber. They may have different resiliences or substantially the same resiliences. The contact springs 131 are formed on the contact spring member 130 in a pattern corresponding to the electrical contacts found on the contact surface 44 (FIG. 15) of the ink cartridge 40 and on the flexible cable 80. Another type of contact spring structure is disclosed in U.S. Pat. No. 4,706,097.

Figure 13:
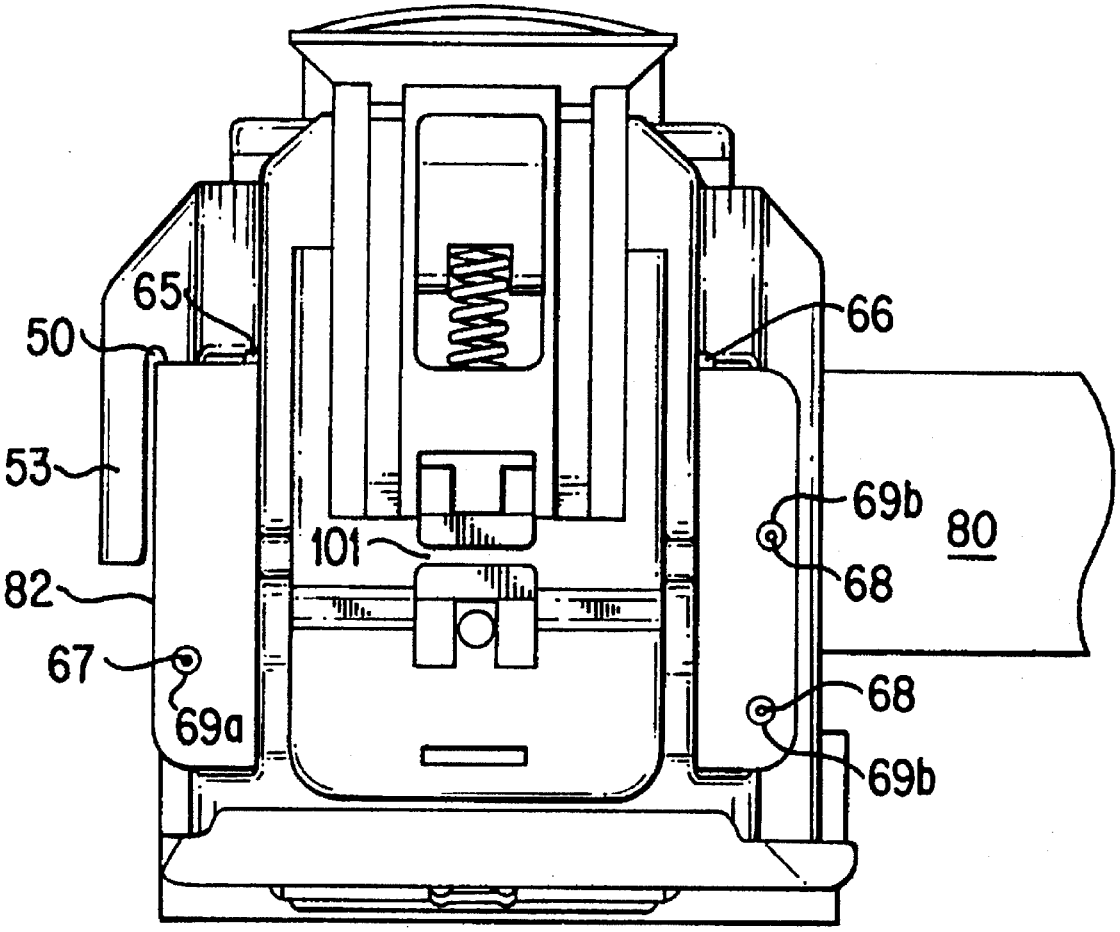
FIG. 13 is a rear view of the ink cartridge carrier with latching bracket and flexible cable mounted thereto.
Figure 14:
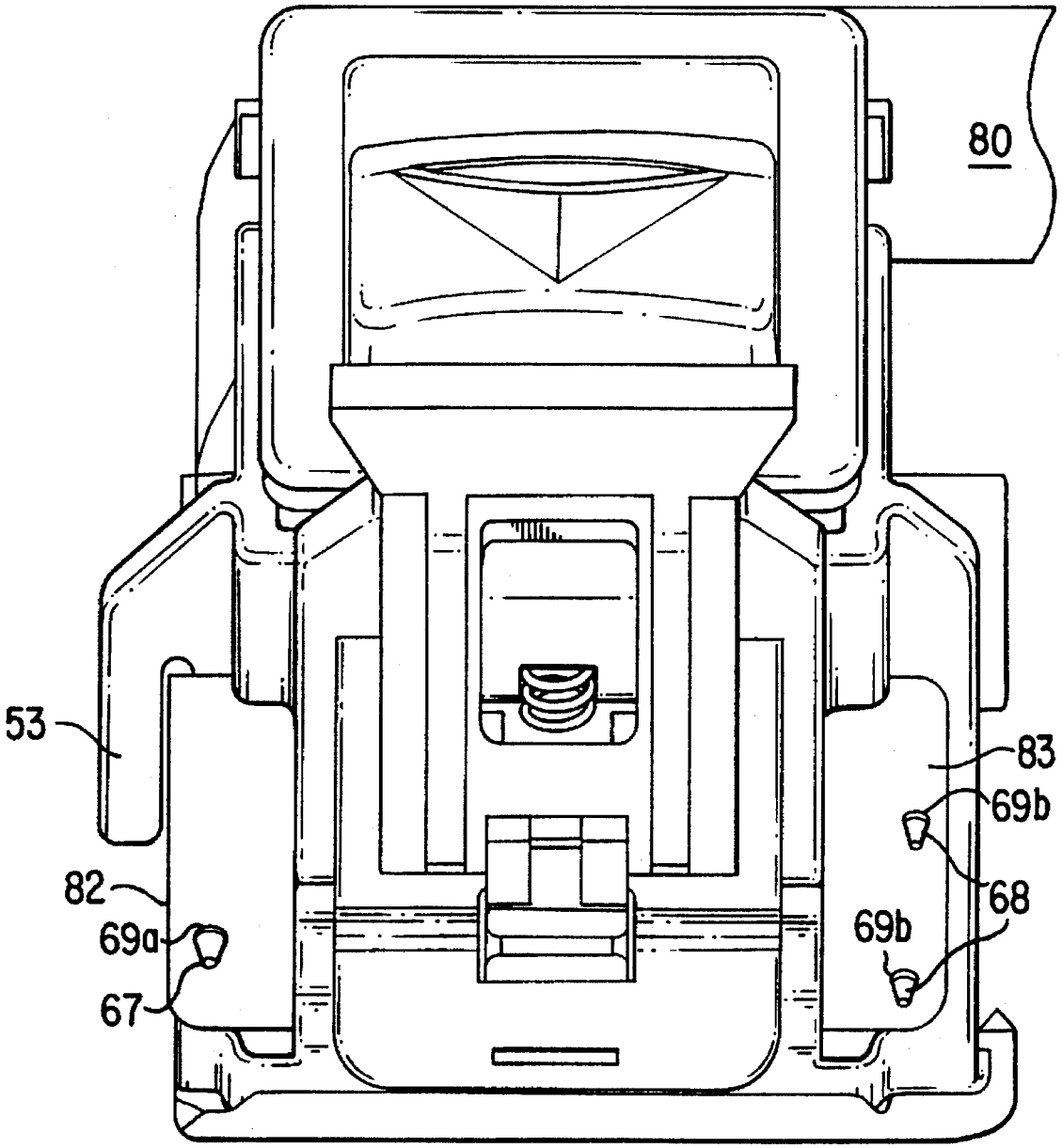
FIG. 14 is a top, rear perspective view of the ink cartridge carrier of FIG. 13.

The flexible cable 80 will be described with reference to FIGS. 2, 4, 12, 13, 14. A mounting bracket 88 is mounted to first lateral frame 72. The flexible cable 80 from the controller (not shown) has a first rigid portion 81 which provides a means for guiding the flexible cable to the cable attachment bracket 88 as well as providing means for a positive mount thereto. A second rigid portion 82 guides the flexible cable 80 around the outer surface of the ink cartridge carrier 54 and through a groove 50 (FIGS. 4, 13 and 14).

Figure 11:
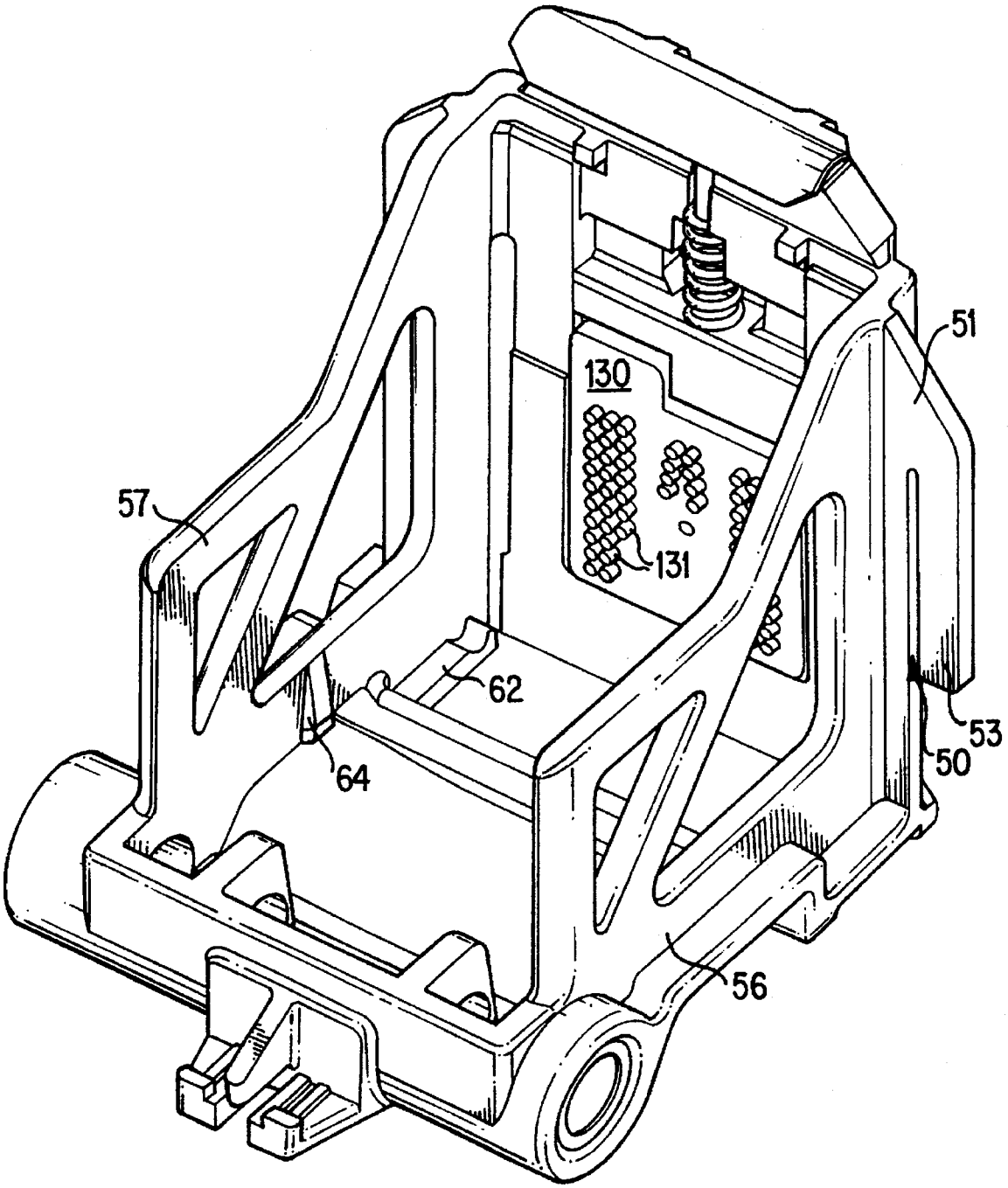
FIG. 11 is a right front, top perspective view of the ink cartridge carrier with latching bracket attached.
Figure 12:
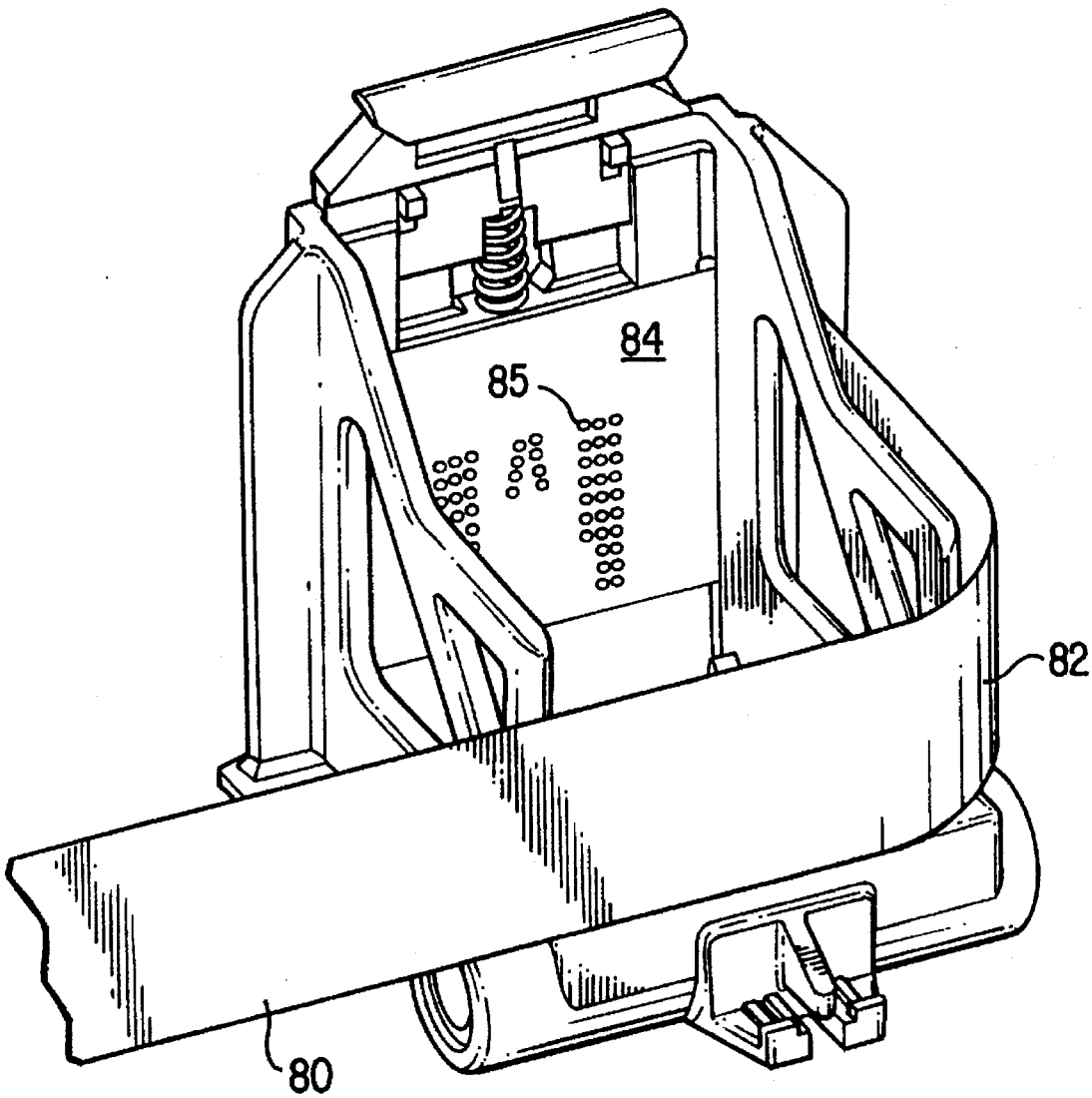
FIG. 12 is a front, top perspective view of the ink cartridge carrier with the flexible cable mounted thereto.

The groove 50 is formed in the wing 51 extending from side frame section 56 (FIG. 11). A hook 53 defines the outer side of the groove and extends approximately one-half the height of the wing 51 or the side frame section 56.

The rigid portions 81,82 are reinforced only where the path of the flexible cable 80 changes direction. Between those points, the flexible cable 80 remains flexible. The high rigidity portions, that is where the direction changes, of the flexible cable 80 may be formed by molding with an increased amount of the resin, used to form the body of the flexible cable 80, forming the high rigidity portions of the rigid portions 81,82 upon curing or by mounting reinforcing material to the flexible cable 80, such as metal or plastic strips. The section of the flexible cable 80 between the first and second rigid portions 81,82 is flexible and bows during reciprocal movement of the ink cartridge carrier 54 so as to permit movement of the ink cartridge carrier 54 from one end of the print line to the other.

One end of the flexible cable 80, adjacent rigid portion 82, permits connection of the flexible cable 80 to the ink cartridge carrier 54. Between the rigid portion 82 and an end portion 83 is a contact portion 84 containing contacts 85. The contacts 85 coincide with the contact springs 131 and the contacts on the contact surface 44 of the ink cartridge 40.

Rigid portion 82 of the flexible cable 80 has a mounting hole **69*a* and cable end 83 has mounting holes 69*b*. The mounting hole 69*a* enables rigid portion 82 to be mounted to the latching pin 67 and the mounting holes 69*b* on the cable end 83 are mounted to the end latching pins 68 thereby positively locating the contacts 85 of contact portion 84 between the contact springs 131 and the contacts found on the ink cartridge 40. Passage of the rigid portion 82 through groove 50 results in the hook 53 providing for a positive retention of mounting hole 69*a* on latching pin 67 to prevent an accidental disconnection of the cable 80 during reciprocable movement of the ink cartridge carrier 54**.

To mount the flexible cable 80 to latching pins 67,68, cable end 83 is passed through the slot 65, past the contact springs 131 and exited from the slot 66 so that the latching holes **69*a*, 69*b* receive the latching pins 67,68**.

Figure 6:
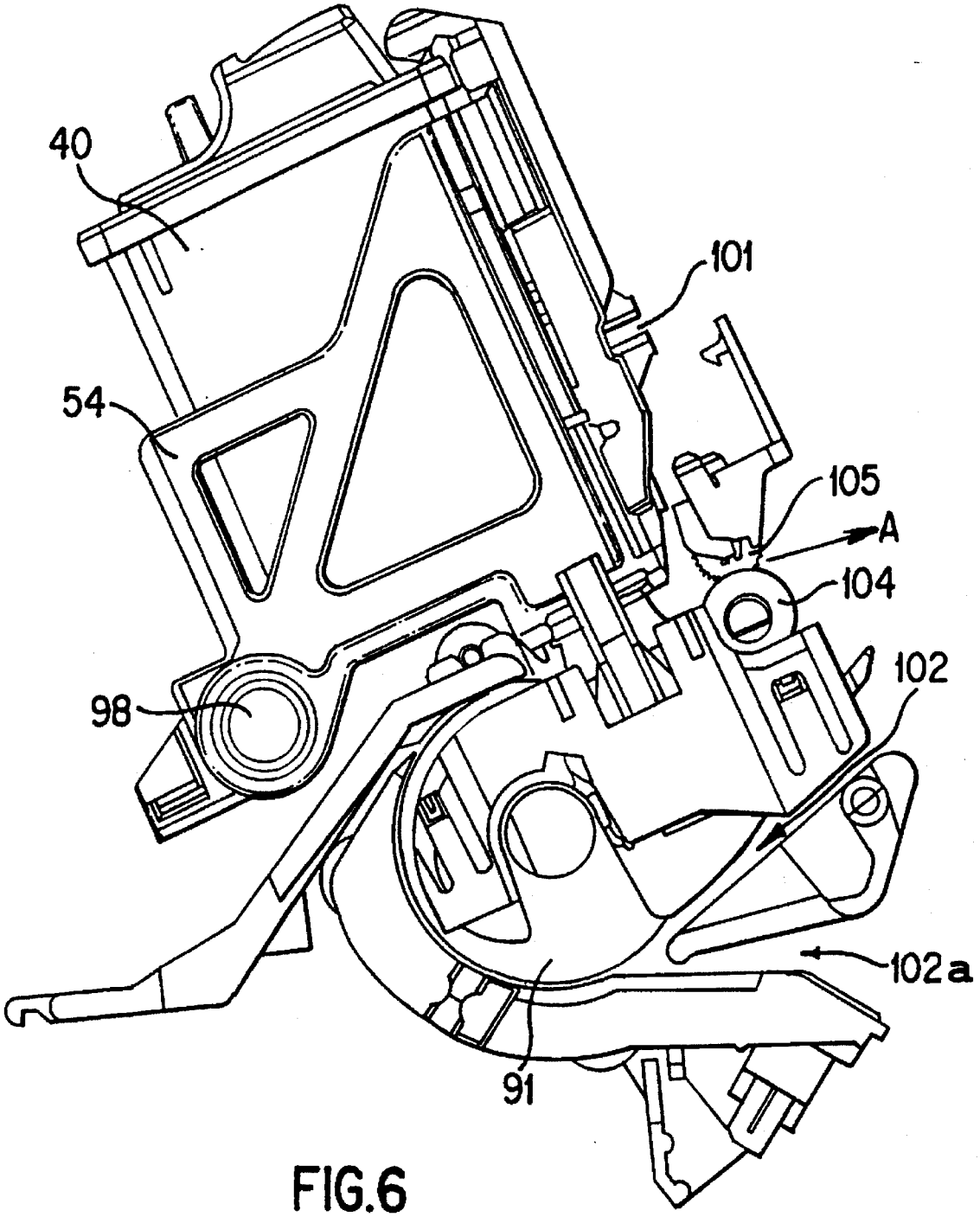
FIG. 6 is a side view of the ink cartridge carrier at the cleaning position.
Figure 7:
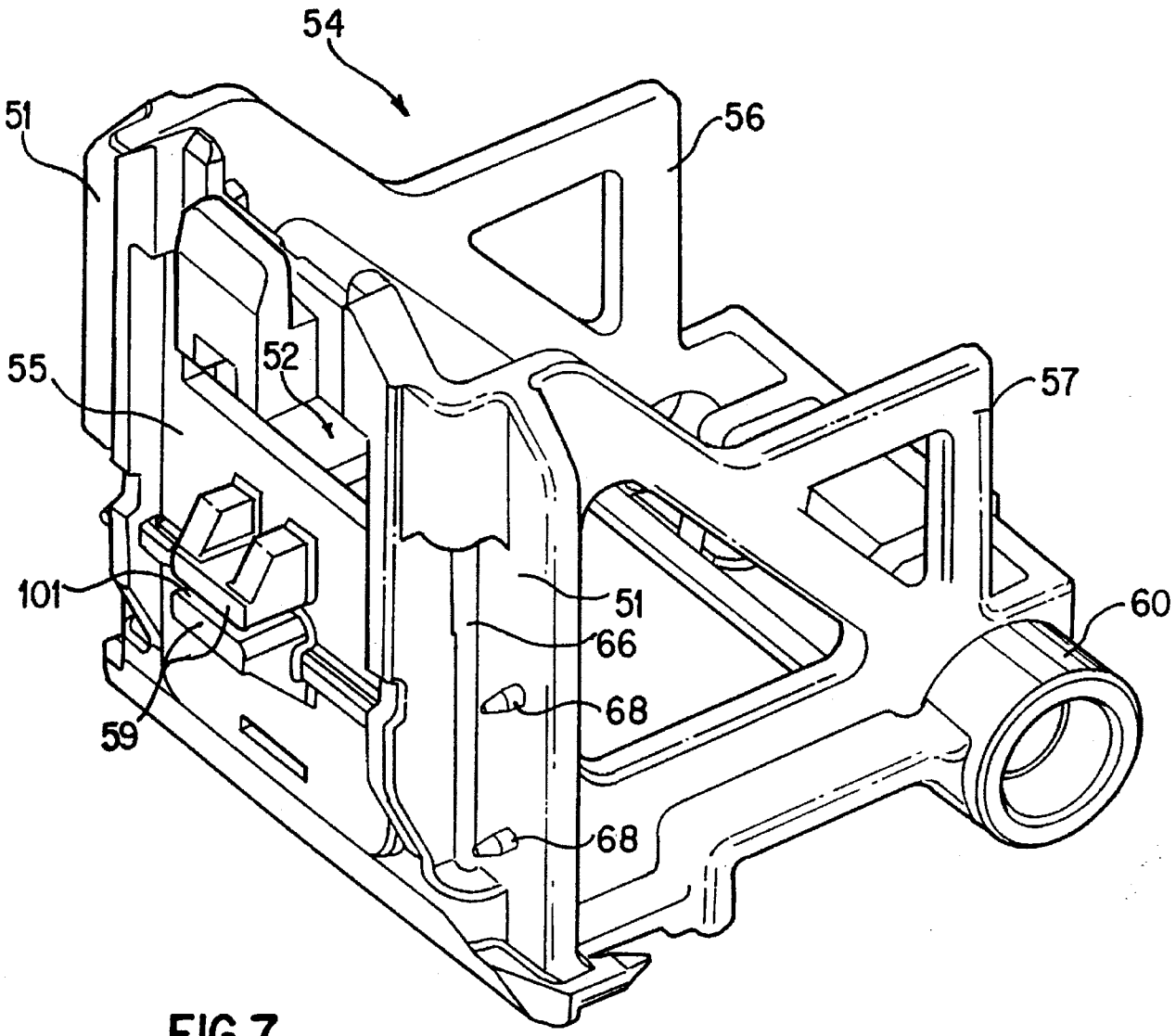
FIG. 7 is a top, rear perspective view of the ink cartridge carrier.
Figure 8:
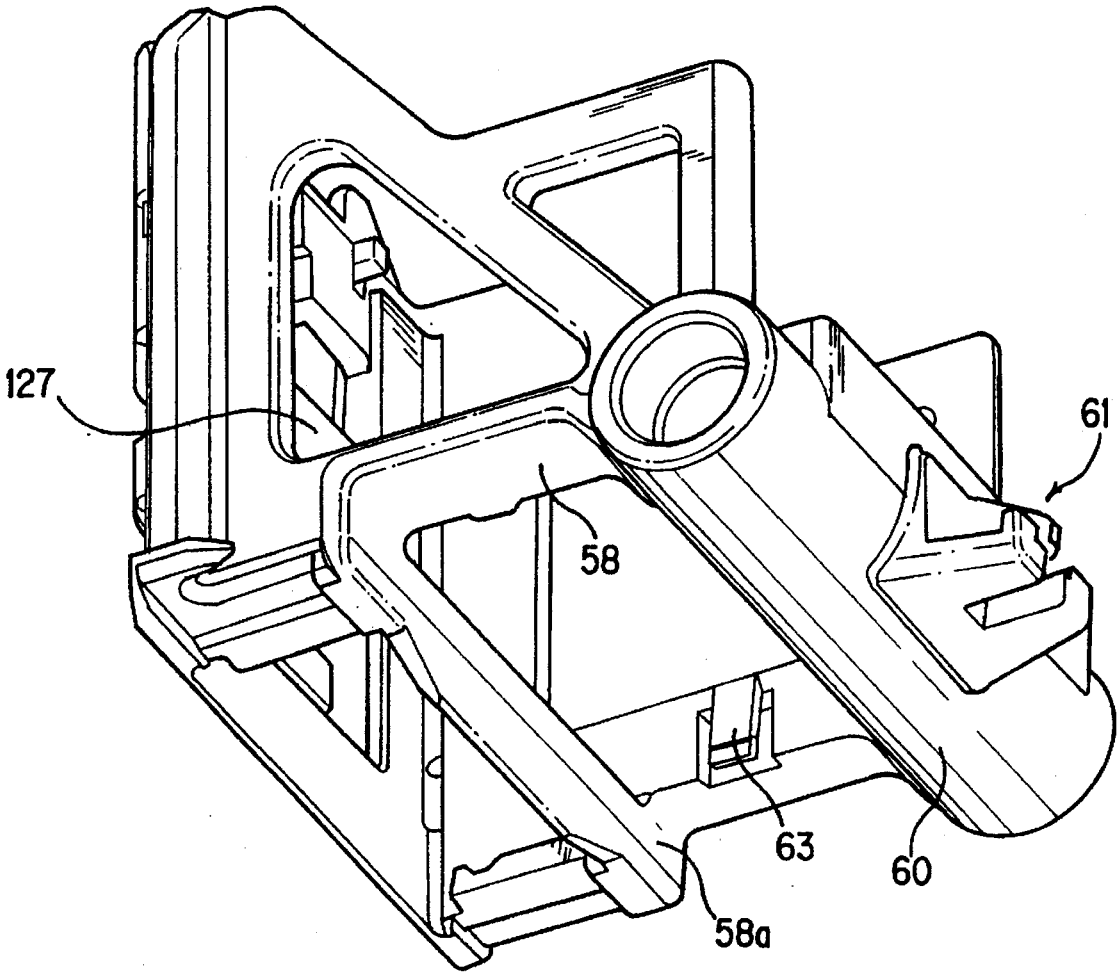
FIG. 8 is a bottom, front perspective view of the ink cartridge carrier.

The ink cartridge 40 for use with the invention will be described with reference to FIGS. 2, 6 and, most particularly, 15. The ink cartridge 40 has an engagement piece 42 on its upper surface (as shown in the Figures). At its lower surface is a nozzle plate 48. At a lower end of each side surface is a mounting foot 46. A front face directly below the engagement piece 42 comprises a contact surface 44 having a plurality of contacts (not shown in detail) corresponding to the number of nozzles thereon.

In operation, the flexible cable 80 is attached to the ink cartridge carrier 41 by inserting the cable end 83 through the slot 65 and exiting the slot 66 thereby positioning the contact portion 84 opposite the contact springs 131 so that the pattern of the contacts 85 on the contact portion 84 is matched with the contact springs 131. The latching holes **69*a*, 69*b* are seated on the latching pins 67,68 to positively position the contact portion 84 of the flexible cable 80**.

The ink cartridge 40 is mounted on the ink cartridge carrier 54 as shown in FIGS. 16–19. The nozzle plate 48 section of the ink cartridge 40 is inserted between the positioning bar **58*a* of the base frame section 58 and the center frame section 55. The upper portion of the ink cartridge 40 is then pushed toward the center frame section 55. A chamfered surface of the engagement piece 42 engages a chamfered surface of the lip 112 of the latching bracket 110. The lip 112 is pushed upwardly against the tension force of the spring 117 until the chamfered surface of the lip 112 passes by the chamfered surface of the engagement piece 42 wherein the tension of the spring 117 retracts the lip 112 over the engagement piece 42 thereby positively engaging and seating the ink cartridge 40 on the ink cartridge carrier 54**.

Further, to properly align the ink cartridge 40 laterally, the second side frame section 57 is provided with a rigid ink cartridge guide 64 and the first side frame section 56 is provided with a semi-rigid ink cartridge guide 63. Clearly, the rigid ink cartridge guide 64 could be on the first side frame section 56 and the semi-rigid ink cartridge guide 63 on the second side frame section 57. At this time, the contacts on the contact surface 44 are in positive contact with the contacts 85 found on the contact portion 84 of the flexible cable 80 and printing may be conducted.

To release an expended ink cartridge 40 from the ink cartridge carrier 41, the operator grasps the ends of the lip 112, pulling the lip 112 upwardly to disengage the lip 112 from the engagement piece 42. The lip 112, on each side, has an angled surface such that the lip is narrower at its bottom surface (closed to the opening 114) and wider at its upper surface for ease in pulling (FIG. 13). The angle formed between the top surface and the angled surface is in a range of about 40° to 60° and is preferably about 50°. During removal, the ink cartridge 40 is rotated toward the guide shaft mount 60 and lifted from its position on the ink cartridge carrier 54.

What is claimed is:

1. A cable connection for use in an ink jet printer, comprising:

an ink cartridge carrier of one piece construction having at least a first section, a second section, a cable mounting section extending between said first section and said second section and a base section to form a substantially box shaped structure with two open sides;

a first wing extending from said first section and a second wing extending from said second section in a direction away from and parallel to said cable mounting section;

a first slot positioned between said first wing and said cable mounting section at an intersection where said cable mounting section and said first section are joined and a second slot positioned between said second wing and said cable mounting section at an intersection where said cable mounting section and said second section are joined; and means for mounting a cable to said ink cartridge carrier.

2. The cable connection according to claim 1, wherein the means for mounting comprises:

said cable having at least one of an end mounting portion and a second mounting position, said at least one end and second mounting portions having attachment means; and mounting means on at least one of said first wing and said second wing for receiving said attachment means.

3. The cable connection according to claim 2, wherein said mounting means is at least one pin.

4. The cable connection according to claim 3, wherein said first wing extending from said first section has one pin and said second wing extending from said second section has two pins.

5. The cable connection according to claim 3, wherein said attachment means has at least one hole for receiving said at least one pin.

6. The cable connection according to claim 1, wherein said cable further comprises a contact portion having a plurality of contacts on a first surface between said end mounting portion and said second mounting portion.

7. The cable connection according to claim 6, further comprising resilient means mounted to said cable mounting section on a side facing a second surface of said cable.

8. The cable connection according to claim 7, wherein said resilient means comprises a plurality of pressure projections.

9. The cable connector according to claim 8, wherein each pressure projection of said plurality of pressure projections corresponds to a contact of said plurality of contacts.

10. The cable connector according to claim 1, wherein said cable passes through said first slot and said second slot when mounted to said ink cartridge carrier.

11. The cable connector according to claim 7, wherein said resilient means is formed of rubber and comprises a backing pad with said plurality of pressure projections extending therefrom.

12. The cable connector according to claim 11, further comprising:

a one of a rigid ink cartridge guide and a semi-rigid ink cartridge guide on said first section; and another of the rigid ink cartridge guide and the semi-rigid ink cartridge guide on said second section, the rigid ink cartridge guide and said semi-rigid ink cartridge guide laterally aligning an ink cartridge.

13. The cable connection according to claim 4, further comprising a groove formed in the wing extending from said first section, said cable passing through said groove.

14. A cable connection for a movable print mechanism in an ink jet printer, comprising:

a flexible cable having a connection end having at least one hole and a contact portion, said flexible cable being connected to a print carriage of one piece construction having a first slot and a second slot; a contact pressure pad mounted to a surface of said print carriage between said first and second slots; and a plurality of pins on said print carriage, wherein said connection end of said flexible cable is detachably mounted to at least one pin of said plurality of pins on said print carriage to position said contact portion of said flexible cable opposite to a contact side of an ink cartridge mounted to said print carriage.

15. The cable connection according to claim 14, wherein said connection end of said flexible cable is fed through said first slot and second the slot to position a non-contact side of said contact portion against said contact pressure pad.

16. The cable connection according to claim 14, wherein said plurality of pins comprises a first portion of said plurality of pins adjacent said first slot and a second portion of said plurality of pins adjacent said second slot, a plurality of holes formed in said flexible cable correspond to said first portion and said second portion of pins to positively engage said plurality of pins.

17. The cable connection according to claim 14, wherein said pressure contact pad comprises a resilient base pad and a plurality of projections corresponding in number and position at least to a plurality of contacts on said contact portion of said flexible cable.

18. The cable connection according to claim 17, further comprising:

a one of a rigid ink cartridge guide and a semi-rigid ink cartridge guide on a first section of said print carriage; and another of the rigid ink cartridge guide and the semi-rigid ink cartridge guide on a second section of said print carriage, the rigid ink cartridge guide and the semi-rigid ink cartridge guide laterally aligning an ink cartridge.

19. The cable connection according to claim 16, wherein said plurality of pins extend from a part of said print carriage on a side facing toward a contact side of said flexible cable such that said contact pressure pad reinforces the positive engagement of the plurality of holes of the flexible cable on the pins.

20. The cable connection according to claim 19, further comprising:

a one of a rigid ink cartridge guide and a semi-rigid ink cartridge guide on a first section of said print carriage; and another of the rigid ink cartridge guide and the semi-rigid ink cartridge guide on a second section of said print carriage, the rigid ink cartridge guide and the semi-rigid ink cartridge guide laterally aligning an ink cartridge.

21. The cable connection according to claim 15, further comprising a wing adjacent said first slot, said wing having a groove formed therein and said cable fed through said groove.

* * * * *